US007849724B2

(12) United States Patent
Kanemitsu et al.

(10) Patent No.: US 7,849,724 B2
(45) Date of Patent: Dec. 14, 2010

(54) METHOD OF MANUFACTURING A RING-SHAPED MEMBER

(75) Inventors: Toshiaki Kanemitsu, Hyogo (JP); Shuji Kanemitsu, Hyogo (JP); Misao Oda, Hyogo (JP); Masataka Ohnishi, Hyogo (JP); Naoki Fujii, Hyogo (JP); Kazuyuki Oda, Hyogo (JP)

(73) Assignee: Kanemitsu Corporation, Ookurahonmachi, Akashi-shi, Hyogo (JP)

( * ) Notice: Subject to any disclaimer, the term of this patent is extended or adjusted under 35 U.S.C. 154(b) by 76 days.

(21) Appl. No.: 12/083,237

(22) PCT Filed: Oct. 13, 2005

(86) PCT No.: PCT/JP2005/018840

§ 371 (c)(1),
(2), (4) Date: Apr. 8, 2008

(87) PCT Pub. No.: WO2007/043176

PCT Pub. Date: Apr. 19, 2007

(65) Prior Publication Data

US 2009/0255318 A1 Oct. 15, 2009

(51) Int. Cl.
*B21D 3/00* (2006.01)
*B21D 41/02* (2006.01)
*B21D 31/00* (2006.01)

(52) U.S. Cl. ..... 72/367.1; 72/393; 72/402

(58) Field of Classification Search ..... 72/399, 72/402, 404, 370.23–370.25, 367.1, 393–395
See application file for complete search history.

(56) References Cited

U.S. PATENT DOCUMENTS

| | | | | |
|---|---|---|---|---|
| 1,091,751 | A * | 3/1914 | Mogan et al. | 72/370.24 |
| 4,467,511 | A * | 8/1984 | Collgon | 72/370.23 |
| 5,526,670 | A * | 6/1996 | Parola | 72/370.23 |
| 6,637,248 | B2 * | 10/2003 | Ishii et al. | 72/370.23 |
| 6,655,182 | B2 * | 12/2003 | Mattsson | 72/370.23 |

FOREIGN PATENT DOCUMENTS

| | | |
|---|---|---|
| JP | 45-5144 B1 | 2/1970 |
| JP | 58-128231 A | 7/1983 |
| JP | 6-47139 B2 | 6/1994 |

* cited by examiner

*Primary Examiner*—Dana Ross
*Assistant Examiner*—Mohammad Yusuf
(74) *Attorney, Agent, or Firm*—Bacon & Thomas, PLLC

(57) ABSTRACT

The outer side of a pair of curved parts 3*d* of a longitudinal annular blank is pressed and energized towards the curved part 3*d* of the opponent side with a molding outer die 14 of a shaping device 13 to press and widen each curved part 3*d* to a large curved part of large curvature radius, and a half-finished article 17 is molded, and thereafter, the half-finished article 17 is pressed and widened by cooperative operation of a finishing inner die of the shaping device and a window part of a perfect circle functioning as an outer die to manufacture a ring-shaped member. Therefore, a yield rate or a percentage of the weight of the ring-shaped member with respect to the weight of the raw material and the yield rate or the percentage of the ring-shaped member with respect to the blank can be improved, and the cost can be reduced.

3 Claims, 14 Drawing Sheets

METHOD OF MANUFACTURING A RING-SHAPED MEMBER

TECHNICAL FIELD

The present invention relates to a method of manufacturing a ring-shaped member.

BACKGROUND ART

A ring-shaped member 1 as shown in FIG. 12 has been conventionally manufactured through a method of punching out a plurality of annular ring-shaped members 1 by one column or a plurality of columns by a pressing device from a raw material 2 having a predetermined plate thickness as shown in FIGS. 13(*a*) and 13(*b*).

However, in the conventional manufacturing method, the yield rate or the percentage of the weight of the ring-shaped member 1 with respect to the weight of the raw material 2 is bad, and tends to increase the cost of the ring-shaped member 1.

This is because the material is removed at high percentage of skeleton S1 and slug S2 with respect to the ring-shaped member 1. The "Skeleton" is a frame shaped scrap that remains after punching out a plurality of ring-shaped members 1, and the "slug" is a plurality of scraps punched out and removed with a punch when punching out the plurality of ring-shaped members 1.

A method of molding the ring-shaped member shown in FIGS. 14(*a*) and 14(*b*) has thus been proposed in Japanese Published Patent Application No. 62-203633.

The method of molding the ring-shaped member described in Japanese Patent Application No. 62-2036331 includes a step of continuously bending the width of an elliptical ring-shaped raw material into a circular shape while preventing the deformation thereof, and a step of making the raw material formed into a circular shape into a perfect circle.

That is, as shown in FIG. 14(*a*), inner and outer rollers 103, 104 that freely rotate and move so as to slidably hold in between one width on the minor side of the elliptical ring-shaped raw material 100, and a pair of freely movable bending rollers 105 are arranged, where the inner and outer rollers 103, 104 are rotated in a direction of an arrow F or in the opposite direction thereof to push the pair of bending rollers 105 in the direction of an arrow G while feeding the elliptical ring-shaped raw material 100 in the direction of an arrow L or in the opposite direction thereof, thereby sequentially performing the curvature process on the linear portion of the raw material 100 to be molded into a raw material 101 of circular shape.

Thereafter, as shown in FIG. 14(*b*), a large diameter inner roller 106 is externally fitted to the inner roller 103 so as to be simultaneously rotatable and inscribed to the raw material 101 formed into a circular shape, and the large diameter inner roller 106 and the outer rollers 103, 104 are rotated in the direction of the arrow F or in the opposite direction thereof to obtain a ring-shaped member 102 molded to a perfect circle.

DISCLOSURE OF THE INVENTION

Problems to be Solved by the Invention

However, in the method of molding the ring-shaped member described in Japanese Published Patent Application No. 62-203633, a curved part 107 having a small curvature radius remaining on the circular raw material 101 is pressed and widened from the inner side with a strong pressing force in the direction of an arrow K by the large diameter inner roller 106. When the curved part 107 of small curvature radius is pressed and widened from the inner side, a large "extension" is generated at the radial inner region of small curvature radius in the curved part 107 thereby thinning the relevant region and concentrating stress. Therefore, cracks may be generated at the radial inner region of the curved part 107 in the process of molding the circular shaped raw material 101 into a perfect circular shaped ring-shaped member 102, which degrades the yield rate or the percentage of the perfect circular shaped ring-shaped member 102 with respect to the elliptical ring-shaped raw material 100, and increases the cost.

The present invention, in view of solving the above problems, aims to provide a method of manufacturing a ring-shaped member that improves the yield rate or the percentage of the weight of the ring-shaped member with respect to the weight of the raw material, and improves the yield rate or the percentage of the ring-shaped member (correspond to ring-shaped part molded into a perfect circle described in the patent document 1) with respect to a longitudinal annular blank (correspond to elliptical ring-shaped raw material described in the patent document 1), even though the method can achieve a cost reduction.

Means for Solving the Problems

A method of manufacturing a ring-shaped member according to the present invention is provided, where a longitudinal annular blank is molded into an annular shape by pressing curved parts at both ends in the longitudinal direction towards the opponent side from the outer side.

The "Blank" is a plate punched out for manufacturing the ring-shaped member.

In this manner, the material is removed such that the percentage of the skeleton and the slug with respect to the ring-shaped member is suppressed low, and the yield rate or the percentage of the weight of the ring-shaped member with respect to the weight of the raw material can be improved. Furthermore, "extension" of the radial inner region having a small curvature radius at the curved parts is suppressed as small as possible by pressing the curved parts at both ends in the longitudinal direction towards the opponent side from the outer side, thinning of the radial inner region can be avoided, and furthermore, flow of material that thickens the curved part is generated and alleviates stress concentration at the radial inner region. As a result, cracks are not generated at the curved part, and the yield rate or the percentage of the ring-shaped member with respect to the longitudinal annular blank can be improved.

The present invention desirably has the longitudinal annular blank molded to an annular shape by a shaping device including an inner die and an outer die. Accordingly, the high quality ring-shaped member can be efficiently manufactured, and cost can be reduced.

The present invention desirably has the longitudinal annular blank which includes linear parts that face each other on both sides in the width direction with a longitudinal hole on the inner side and curved parts for continuing both ends in the longitudinal direction of the linear parts; and the dimension in the width direction of the longitudinal annular blank is widened by pressing and energizing the linear parts by the inner die fitted into the longitudinal hole, the outer side of the curved parts are pressed and energized towards the curved parts of the opponent side by a molding outer die with a holding inner die fitted into the longitudinal hole whose dimension in the width direction is widened, and the curved parts are pressed and widened to a large cured part having a large curvature radius.

Therefore, if the outer side of the curved part is pressed and energized towards the curved part on the opponent side by the molding outer die with the holding inner die fitted into the longitudinal hole which dimension in the width direction has been widened after the dimension in the width direction of the longitudinal annular blank is widened by the inner die fitted into the longitudinal hole, such curved part is pressed inward from the outer side by the molding outer die while being positioned with the movement towards the curved part on the opponent side regulated by the holding inner die, whereby "extension" of the radial inner region having a small curvature radius at the curved parts is suppressed as small as possible, the thinning of the radial inner region is avoided, and furthermore, stress does not concentrate at the radial inner region and thus cracks are not generated at the curved part, and both curved parts are easily molded into a large curved part of large curvature radius.

Furthermore, the present invention may have both end faces in the width direction of the longitudinal annular blank which are formed by both end faces in the width direction of the raw material, and the curved parts for continuing the linear parts to each other which are formed at both ends in the longitudinal direction by cutting the raw material. Accordingly, the material can be removed such that the percentage of scrap with respect to the longitudinal annular blank is suppressed to a minimum, and in consequence, the yield rate or the percentage of the weight of the ring-shaped member with respect to the weight of the raw material can be improved.

EFFECTS OF THE INVENTION

According to the present invention, the ring-shaped member is manufactured by molding the longitudinal annular blank into an annular shape by pressing the curved parts at both ends in the longitudinal direction towards the opponent side from the outer side, and thus the yield rate or the percentage of the weight of the ring-shaped member with respect to the weight of the raw material improves and the cost of the ring-shaped member reduces by removing the material such that the percentage of the skeleton and the slug with respect to the ring-shaped member is suppressed low, and furthermore, "extension" of the radial inner region having a small curvature radius at the curved parts at both ends in the longitudinal direction is suppressed as small as possible, thinning of the radial inner region is avoided, and furthermore, flow of material that thickens the curved part is generated so that stress does not concentrate at the radial inner region. As a result, cracks are not generated at the curved part, and the yield rate or the percentage of the ring-shaped member with respect to the longitudinal annular blank can be improved.

BEST MODE FOR CARRYING OUT THE INVENTION

A preferred embodiment of the method of manufacturing the ring-shaped member according to the present invention will now be described based on the drawings.

Figure 1:
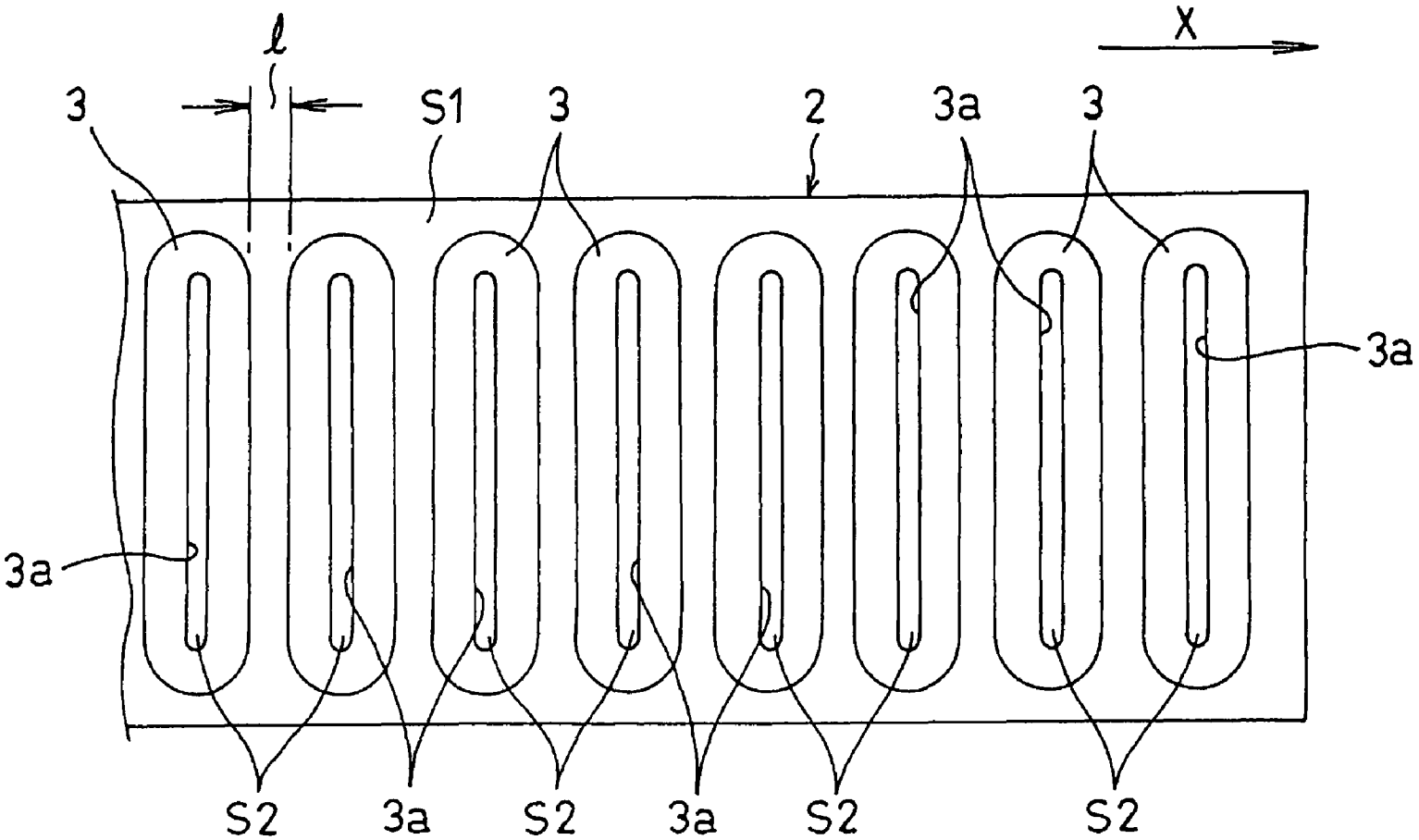
FIG. 1 is a plan view showing a first embodiment of a step of punching out blanks from a raw material.
Figure 2:
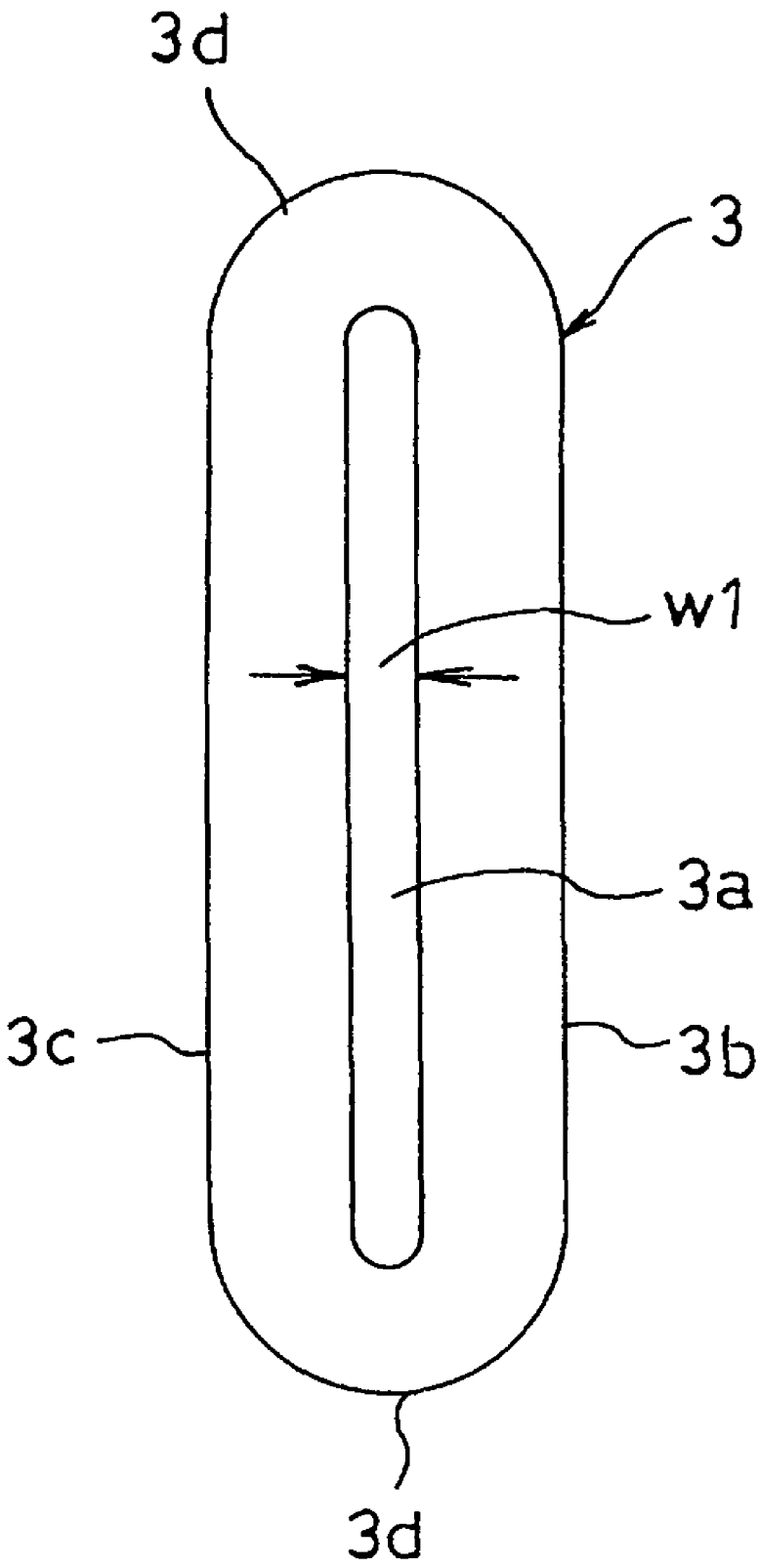
FIG. 2 is an enlarged front view showing the blank punched out from the raw material of FIG. 1.
Figure 3:
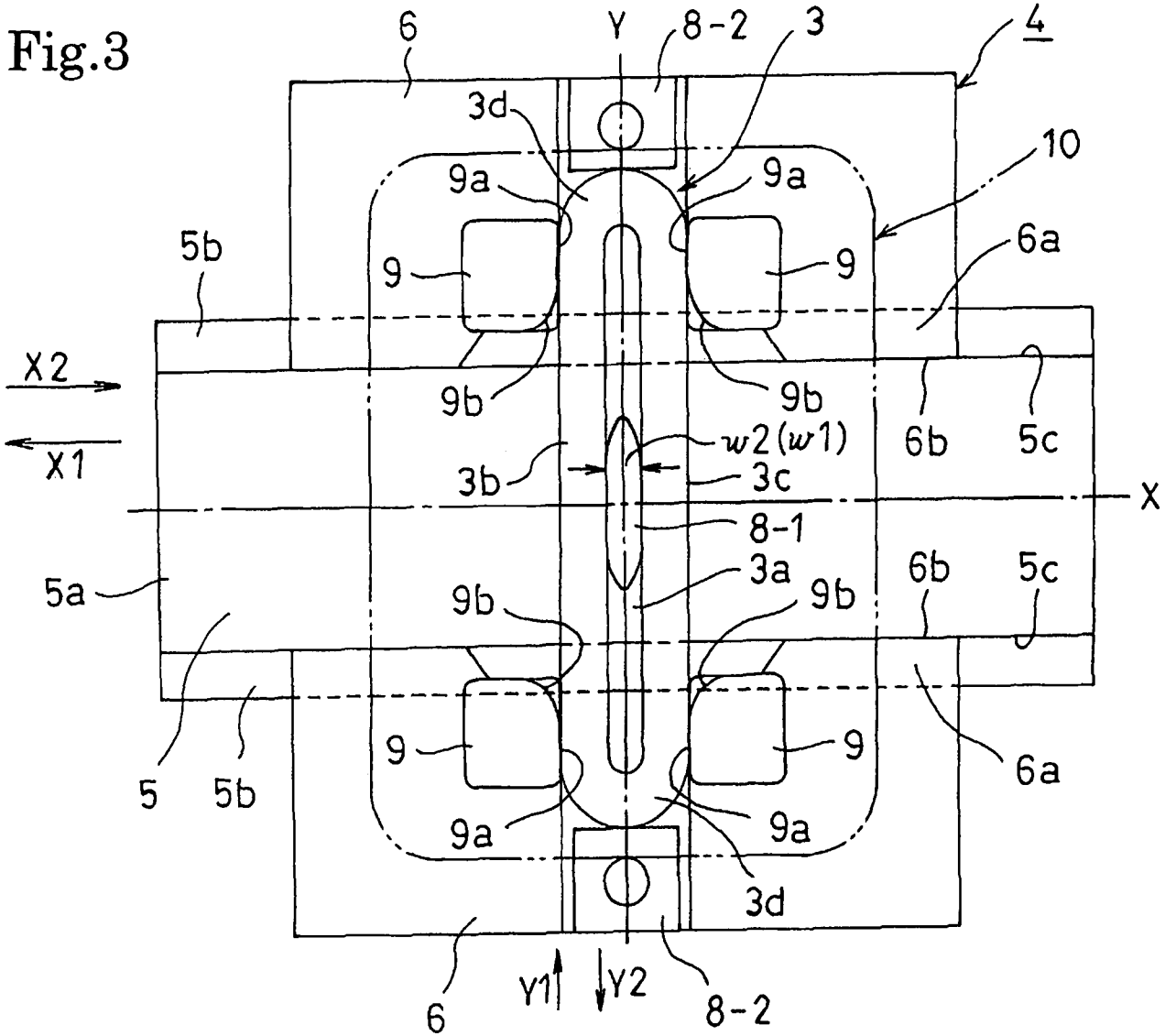
FIG. 3 is a plan view showing an embodiment in which the blank is set in a first shaping device.

As shown in FIG. 1, a plurality of longitudinal annular blanks 3 are punched out in series at a predetermined spacing 1 in the feeding direction by a pressing device while feeding the raw material 2 of a predetermined plate thickness in the longitudinal direction of the raw material 2 as shown with an arrow X. The longitudinal annular blank 3 includes linear parts 3*b*, 3*c* on the left and right sides facing each other with a longitudinal hole 3*a* having a small width dimension w1 on the inner side, and a pair of curved parts 3*d* continuing both ends in the longitudinal direction of the linear parts 3*b*, 3*c*, as shown in FIG. 2, and the longitudinal annular blank 3 is set in a first shaping device 4, as shown in FIG. 3.

The first shaping device 4 includes a moving plate 5 and a pair of front and back guide plates 6, where the moving plate 5 is guided by the guide plates 6 to move forward and backward in the left and right direction (direction of arrow X1, X2) by a forward/backward movement mechanism (not shown). The moving plate 5 includes a main body part 5*a*, and collar parts 5*b*, 5*b* formed on both ends in the front and back direction of the main body part 5*a*, where the collar parts 5*b*, 5*b* slidably go under the lower side of the edges 6*a*, 6*a* at the side facing the opponent in the guide plate 6, and a vertical step difference surface 5*c* formed at the boundary of the main body part 5*a* and the collar parts 5*b*, 5*b* is arranged so as to slidably contact the end surface 6*b* at the side facing the opponent in the guide plate 6. An inner die 8-1 having a boat shape in a projected plane is projected upward at the central part of the main body part 5*a* in the moving plate 5 on the line Y orthogonal to line X. The width dimension w2 of the inner die 8-1 is set to a size slightly smaller than the width dimension w1 of the longitudinal hole 3*a* so as to fit into the longitudinal hole 3*a* of the blank 3.

A pair of front and back positioning projections 8-2, and two pairs of front and back positioning/deformation tolerating projections 9 are arranged on the guide plate 6 in the first shaping device 4. As mentioned below, the pair of positioning projections 8-2 is provided to prevent the longitudinal annular blank 3 from moving in the direction of the arrow Y1, Y2 and to position the longitudinal annular blank 3 at an appropriate position when the longitudinal annular blank 3 is set in the first shaping device 4, and furthermore, is arranged at symmetrical positions with the line X in between so as to face each other on the line Y orthogonal to the line X, where the distance in between is set to a value slightly larger than the dimension in the longitudinal direction of the longitudinal annular blank 3 to enable the setting of the longitudinal annular blank 3.

As mentioned below, the two pairs of front and back positioning/deformation tolerating projections 9 are provided to prevent the longitudinal annular blank 3 from moving in the direction of the arrows X1, X2 and to position the longitudinal annular blank 3 at an appropriate position as well as to tolerate the deformation of the longitudinal annular blank 3 by an inner die 7 when the longitudinal annular blank 3 is set in the first shaping device 4, and is further arranged at symmetrical positions with the line X and the line Y passing through the center of the moving plate 5 in between, where the distance in between in the direction of the line X is set at a value slightly larger than the dimension in the width direction of the longitudinal annular blank 3 to enable the setting of the longitudinal annular blank 3. Each positioning/deformation tolerating projection 9 has a circular arc shaped deformation tolerating surface 9*b* formed in continuation to the positioning surface 9*a* that is parallel to the line Y.

As shown in FIG. 3, when the longitudinal annular blank 3 is set in the first shaping device 4, an upper die 10 shown by a double-chain dashed line is lowered from above. The upper surfaces of the guide plate 6, the positioning projection 8-2, and the positioning/deformation tolerating projection 9 are thereby pressed by the lower surface of the upper die 10, and the upper surfaces of the blank 3 and the inner die 8-1 face the lower surface of the upper die 10 by way of an extremely small gap (small gap allowing slide movement) thereby preventing a warp of the blank 3.

Figure 4:
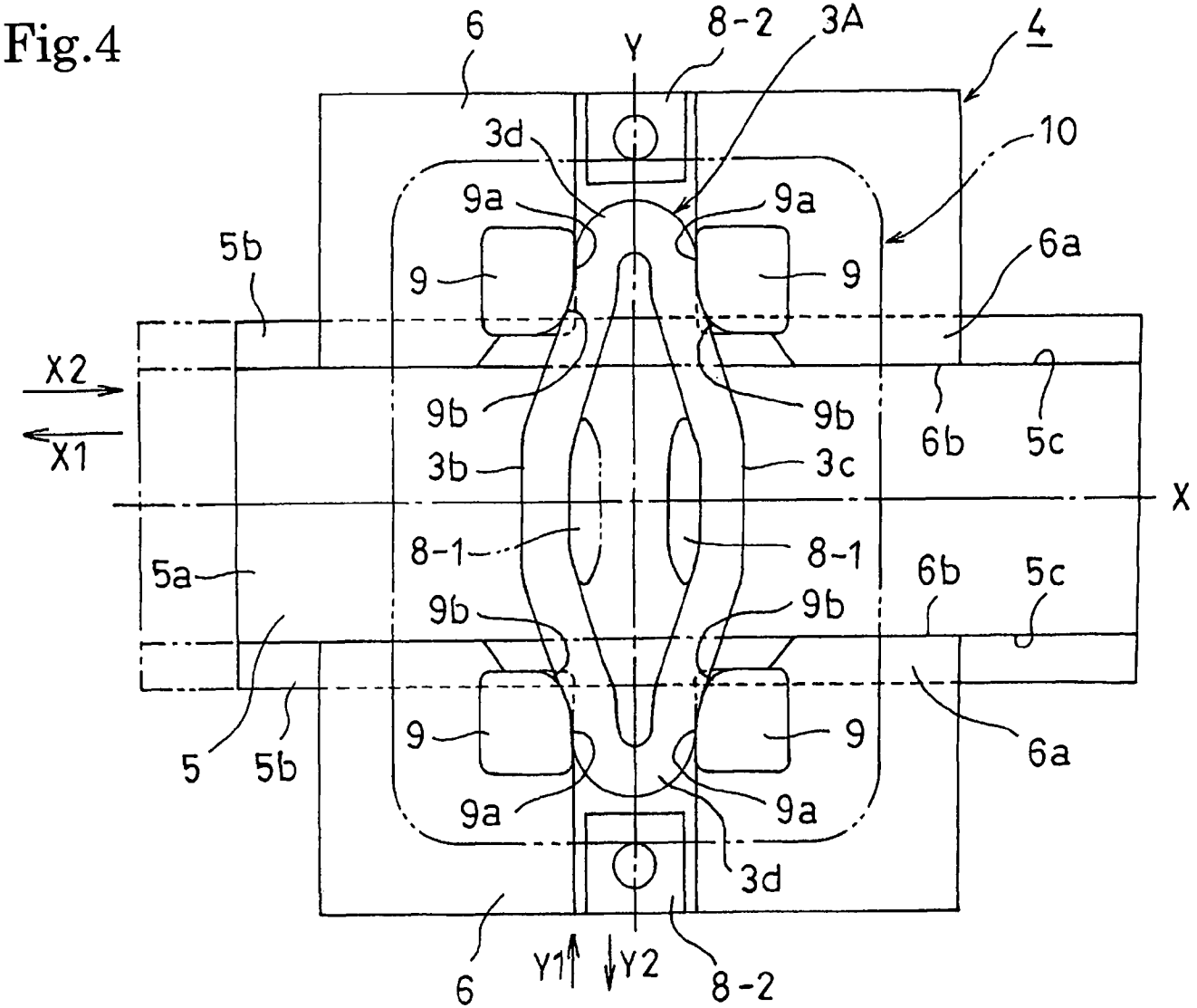
FIG. 4 is a plan view showing an embodiment of a state in which the deformed blank is molded by the first shaping device.

The moving plate 5 is moved in the direction of the arrow X2 in this state. The inner die 7 presses and energizes the linear part 3*c* on the right side of the longitudinal annular blank 3 in the direction of the arrow X2 from the inner side to bend in the direction of the arrow X2 as shown in FIG. 4, and subsequently, the moving plate 5 is moved in the direction of the arrow X1 so that the inner die 7 presses and energizes the linear part 3*b* on the left side (see FIG. 3) of the longitudinal annular blank 3 in the direction of the arrow X1 from the inner side to bend in the direction of the arrow X1 as shown in FIG. 4, where a longitudinal annular blank 3A in which the dimension in the width direction is widened and deformed from the dimension in the width direction of FIG. 3 is molded. In the process of molding, the widening deformation of the linear parts 3*b*, 3*c* on both left and right sides of the longitudinal annular blank 3 shown in FIG. 3 is tolerated since the outer surface in the width direction of the region near the curved part 3*d* of the linear parts 3*b*, 3*c* is widened until contacting the circular arc shaped deformation tolerating surface 9*b* of each of the two pairs of positioning/deformation tolerating projection 9, and the thinning of the widened and deformed part in time of widening deformation is suppressed since the deformation tolerating surface 9*b* is formed into a circular arc shape.

Figure 5:
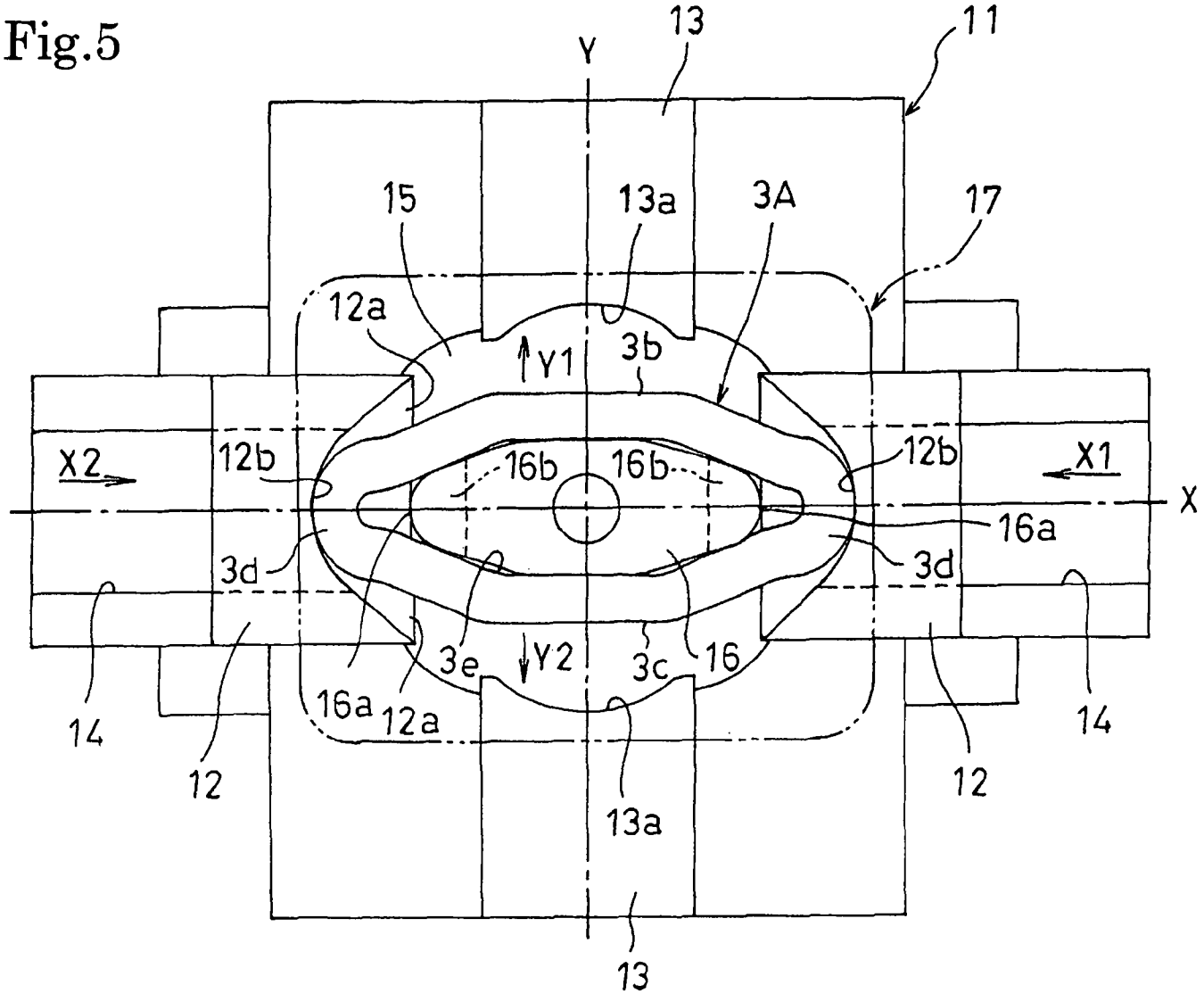
FIG. 5 is a plan view showing an embodiment of a state in which the deformed blank is set in a second shaping device.

In the next step, the deformed longitudinal annular blank 3A shown in FIG. 4 is set in a second shaping device 11 shown in FIG. 5.

The second shaping device 11 includes a pair of left and right molding outer dies 12, and a pair of front and back regulating dies 13, where the molding outer die 12 is guided by a guide groove 14 and is moved forward and backward in the left and right direction (direction of arrows X1, X2) on the base 15 by a forward/backward movement mechanism (not shown).

The molding outer die 12 includes a mounting surface 12*a* and a pressing surface 12*b* projecting vertically upward from the mounting surface 12*a* and having the projected plane depressed into a circular arc shape, where the curvature radius of the pressing surface 12*b* is set to a value larger than the curvature radius of the outer peripheral surface of the curved part 3*d* in the deformed longitudinal annular blank 3A. The regulating die 13 is formed at the end face on the side facing the opponent with a regulating surface 13*a* having the projected plane depressed into a circular arc shape. Furthermore, a holding inner die 16 projecting upward from the upper surface at the central part of the base 15 and having a boat shape in projected plane view is arranged extending in the direction of the line X, where the width dimension of the holding inner die 16 is set to a dimension slightly smaller than the width dimension of the longitudinal hole 3*e* so as to be fitted to the longitudinal hole 3*e* of the deformed longitudinal annular blank 3A. A circular arc shaped holding surface 16*a* is arranged vertically at both ends on the line X of the holding inner die 16, and a cut-out part 16*b* is formed on the lower side of the holding surface 16*a* and the vicinity thereof.

As shown in FIG. 5, after the longitudinal annular blank 3A is set in the second shaping device 11 with the holding inner die 16 sandwiched by the linear parts 3*b*, 3*c* of the deformed longitudinal annular blank 3A and the curved part 3*d* and the vicinity of the blank 3A mounted on the mounting surface 12*a* of the molding outer die 12, an upper die 17 shown by a double chain-dashed line is lowered from above. The upper surfaces of the regulating die 13 and the holding inner die 16 are pressed by the lower surface of the upper die 17, and the upper surfaces of the longitudinal annular blank 3A and the molding outer die 12 face the lower surface of the upper die 17 by way of an extremely small gap (small gap allowing slide movement) thereby preventing the warp of the blank 3A.

Figure 6:
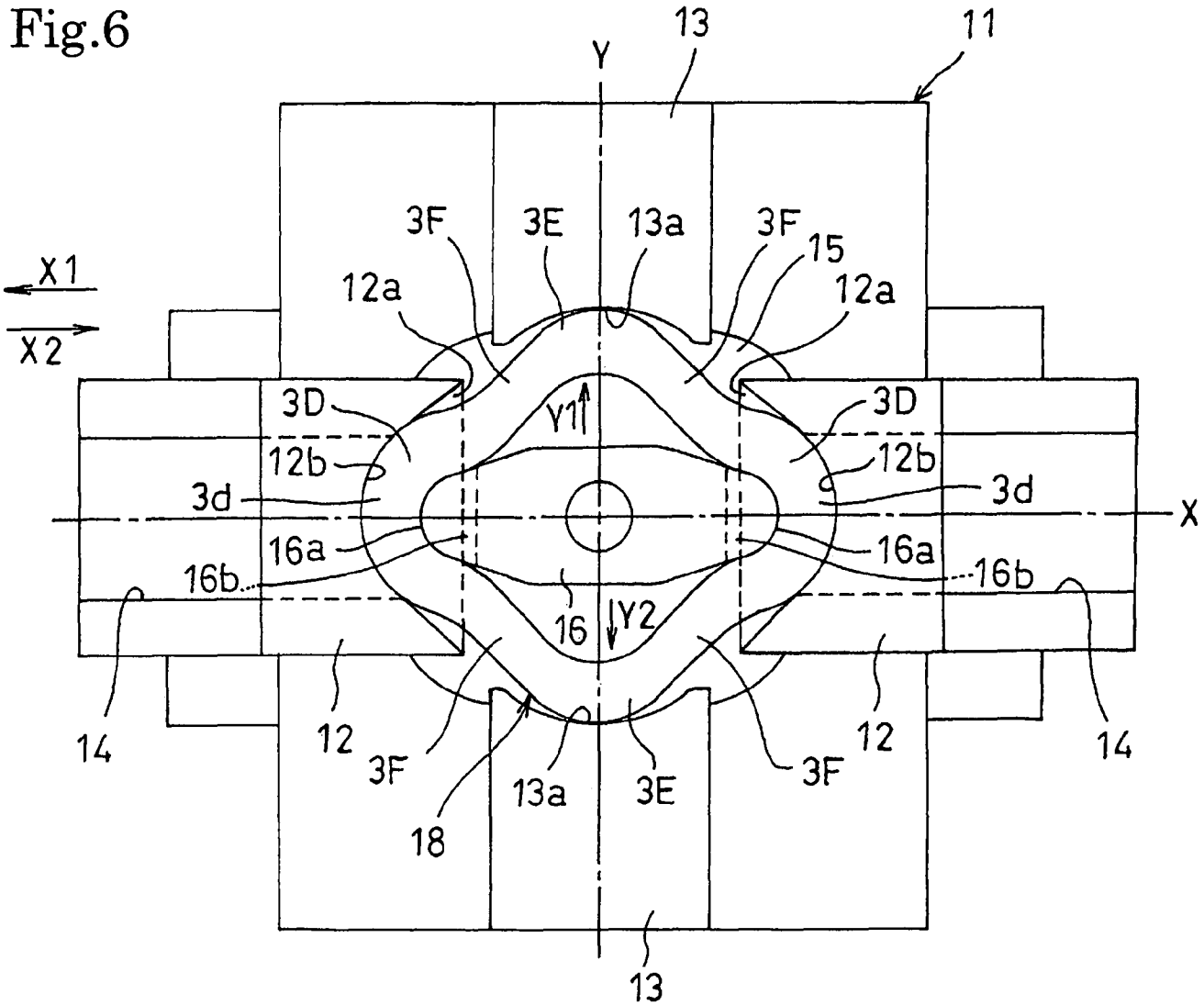
FIG. 6 is a plan view showing an embodiment of a state in which a half-finished article is molded by the second shaping device.

The molding outer dies 12 are moved in the direction of the arrows X1, X2 in this state. The pressing surface 12*b* of the molding outer die 12 thereby presses and energizes the outer side of the curved part 3*d* of the deformed longitudinal annular blank 3A towards the curved part 3*d* on the opponent side. In this case, the mounting surface 12*a* of the molding outer die 12 enters the cut-out part 16*b* of the holding inner die 16. Therefore, as shown in FIG. 6, both curved parts 3*d* are deformed along the pressing surface 12*b* when the radial outer surface of large curvature radius is pressed inward from the outer side by the pressing surface 12*b* depressed into a circular arc shape of the molding outer die 12 with the radial inner surface slightly pressed and widened by the circular arc shaped holding surface 16*a* of the holding inner die 16 and positioned with the movement in the directions of the arrows X1, X2 regulated, and thus "extension" is generated in the radial outer region having large curvature radius and "extension" in the radial inner region having small curvature radius in the curved part 3*d* are suppressed as much as possible, thinning of the radial inner region is avoided, and furthermore, flow of material that thickens the curved part 3*d* is generated so as to alleviate stress concentration at the radial inner region. As a result, both curved parts 3*d* can be molded to a large curved part 3D having a large curvature radius and being advantageous in manufacturing the ring-shaped member 1 without generating cracks at the curved part 3*d*, and thus the yield rate or the percentage of the ring-shaped member 1 with respect to the longitudinal annular blank 3A can be improved.

In the process of molding both curved parts 3*d* to the large curved part 3D having a large curvature radius, the linear parts 3*b*, 3*c* in the deformed longitudinal annular blank 3A shown in FIG. 5 are widened in the direction of the arrows Y1, Y2 thereby forming a curved bulge-out-part 3E at the central part, as shown in FIG. 6, where the deformed longitudinal annular blank 3A (see FIG. 5) is regulated from widening in excess in the direction of the arrows Y1, Y2 when the outer surface of the bulge-out part 3E contacts the regulating surface 13*a* depressed into a circular arc shape of the regulating die 13, and a half-finished article 18 including a pair of large curved parts 3D of large curvature radius and a pair of curved bulge-out parts 3E, and having the large curved parts 3D and the bulge-out parts 3E continuously connected to each other by way of four short linear parts 3F is molded.

Figure 7:
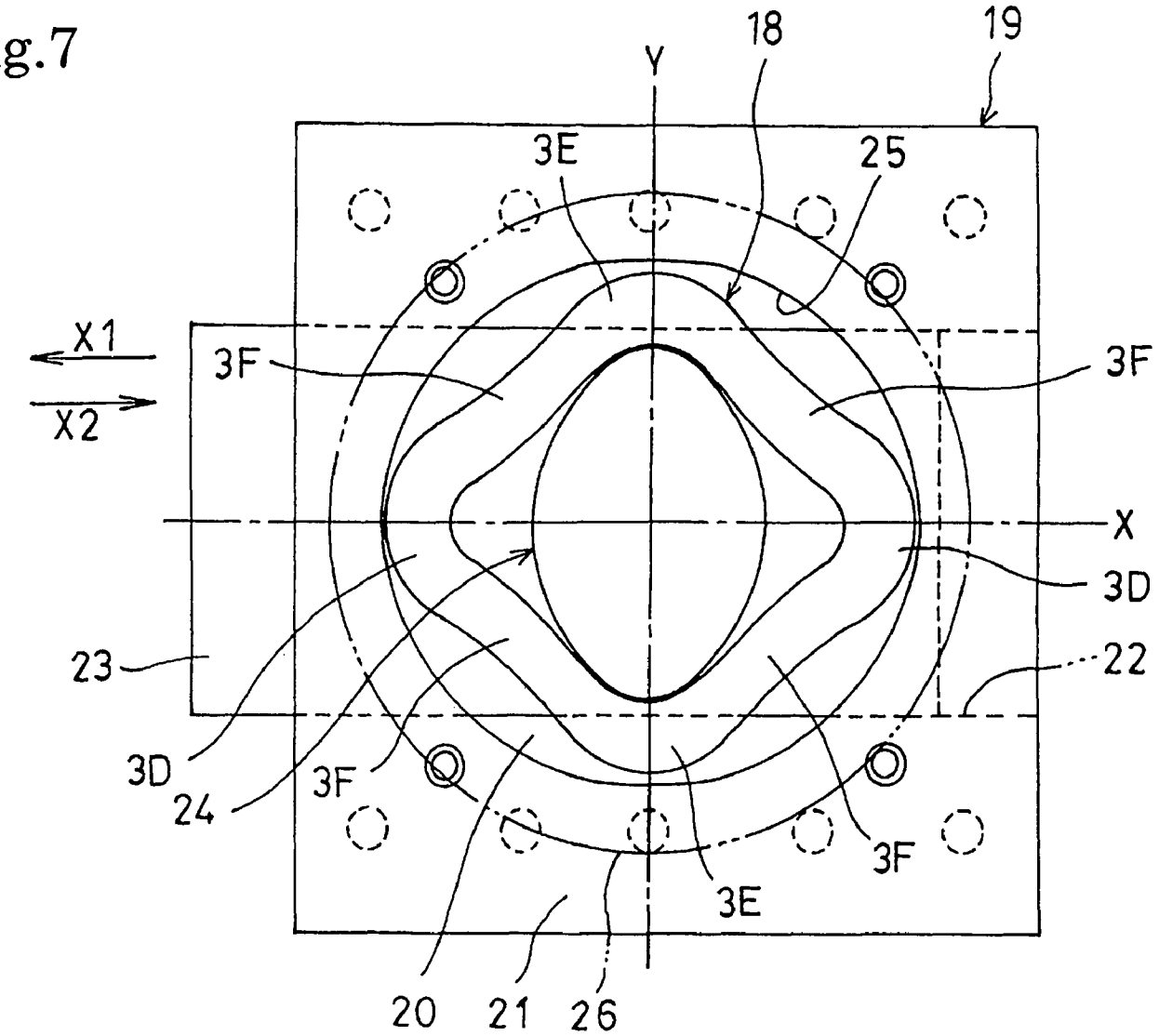
FIG. 7 is a plan view showing an embodiment of a state in which the half-finished article is set in a third shaping device.

The half-finished article 18 shown in FIG. 6 is further set in a third shaping device 19 shown in FIG. 7 in the next step.

The third shaping device 19 includes a base 20, and an upper plate 21 for blocking the upper surface of the base 20 by way of a spacing in the height direction, where a guide groove 22 is formed in the base 20 on the line X passing through the center, and a moving plate 23 that freely moves forward and backward in the direction of the arrows X1, X2 is fitted into the guide groove 22. The moving plate 23 moves forward and backward in the direction of the arrows X1, X2 by a forward/backward moving mechanism (not shown). The upper surface of the moving plate 23 is in plane with the upper surface of the base 20, and a finishing inner die 24 having an elliptical shape in a projected plane view is arranged at the central part so as to project upward on a line Y passing through the center of the base 20 and being orthogonal to the line X. The finishing inner die 24 faces a window part 25 of a substantially perfect circle formed on the upper plate 21, and the inner peripheral surface of the window part 25 functions as an outer die.

As shown in FIG. 7, when the half-finished article 17 is set in the third shaping device 19, an upper die 26 shown with a double chain-dashed line is lowered from above. The upper surface of the upper plate 21 is thereby pressed by the lower surface of the upper die 26, and the upper surfaces of the half-finished article 17 and the finishing inner die 24 face the lower surface of the upper die 26 by way of an extremely small gap (small gap allowing slide movement) thereby preventing the warp of the half-finished article 17.

Figure 8:
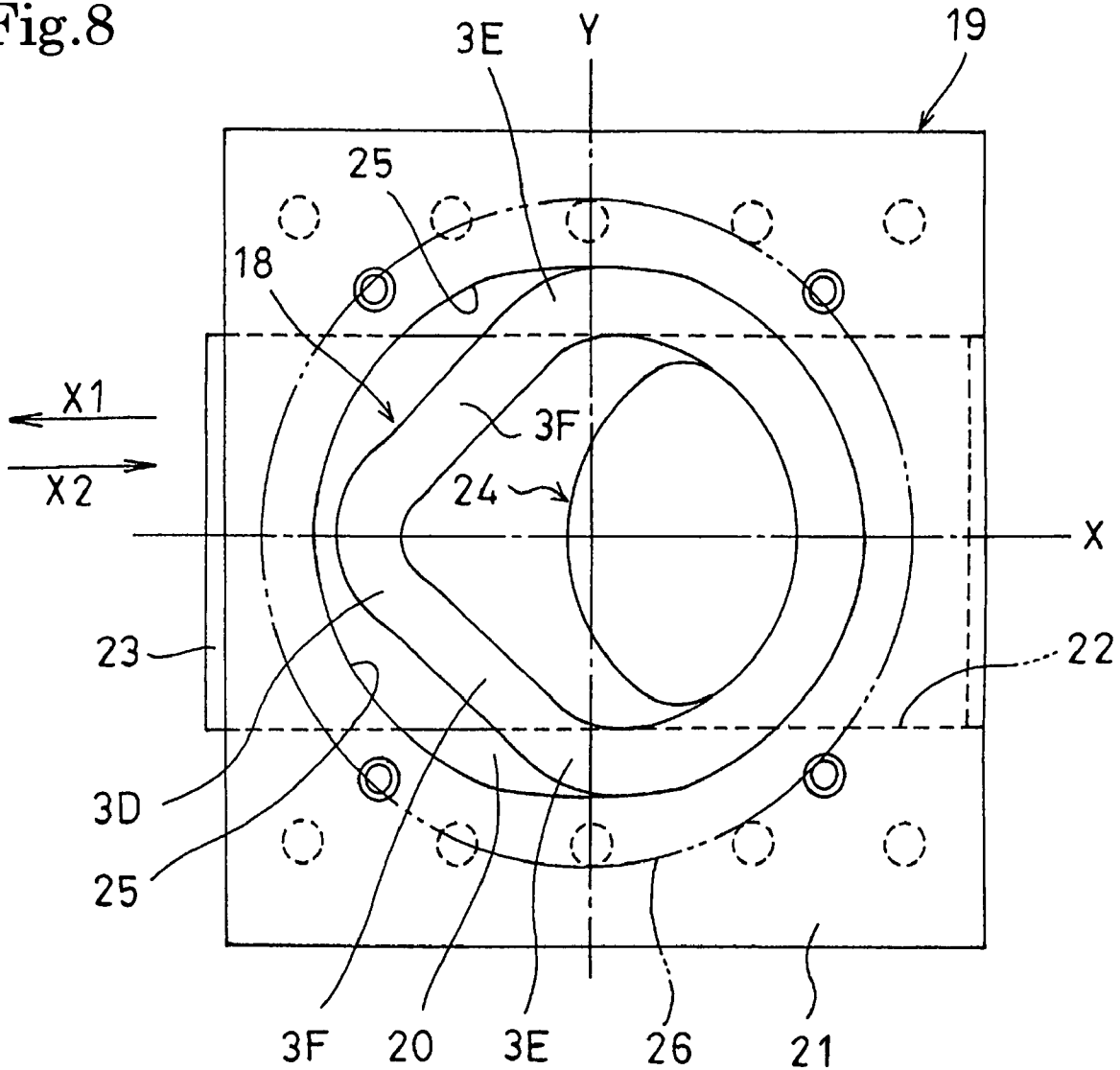
FIG. 8 is a plan view showing an embodiment of a state in which the right half portion of the half-finished article is molded into a semicircle by the third shaping device.

The moving plate 23 is moved in the direction of the arrow X2 in such state. The finishing inner die 24 presses and energizes the right half portion of the half-finished article 17 in the direction of the arrow X2 from the inner side and presses the outer peripheral surface of the right half portion against the inner peripheral surface of the right half portion in the window part 25 of a substantially perfect circle, as shown in FIG. 8, thereby molding the right half portion of the half-finished article 18 into a semicircle. Subsequently, the moving plate 23 is moved in the direction of the arrow X1. The finishing inner die 24 thereby presses and energizes the left half portion of the half-finished article 18 in the direction of the arrow X1 from the inner side and presses the outer peripheral surface of the left half portion against the inner peripheral surface of the left half portion in the window part 25 of a substantially perfect circle as shown in FIG. 9, thereby molding the left half portion of the half-finished article 18 into a semicircle to manufacture a ring-shaped member 1 shown in FIG. 9 and FIG. 12.

Figure 9:
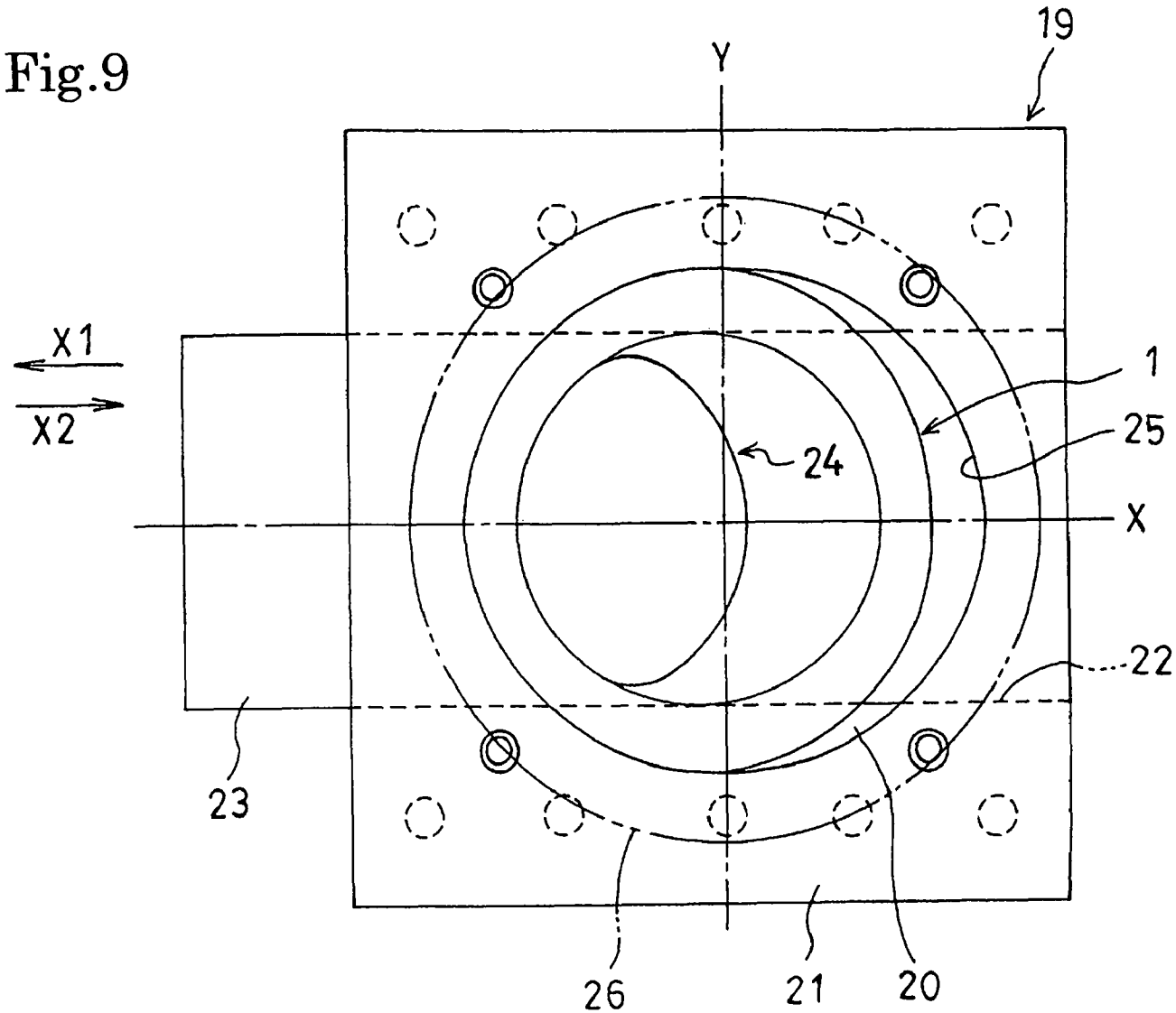
FIG. 9 is a plan view showing an embodiment of a state in which the half-finished article is molded into a ring-shaped member by the third shaping device.
Figure 12:
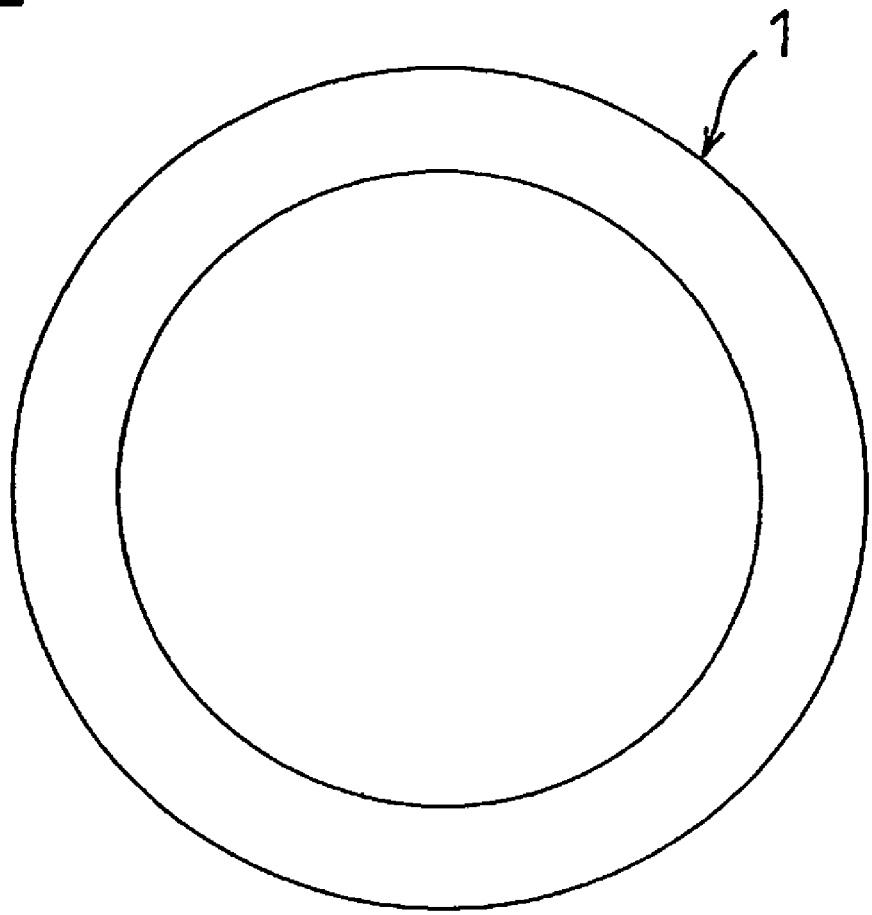
FIG. 12 is a front view showing one example of the ring-shaped member.
Figure 13:
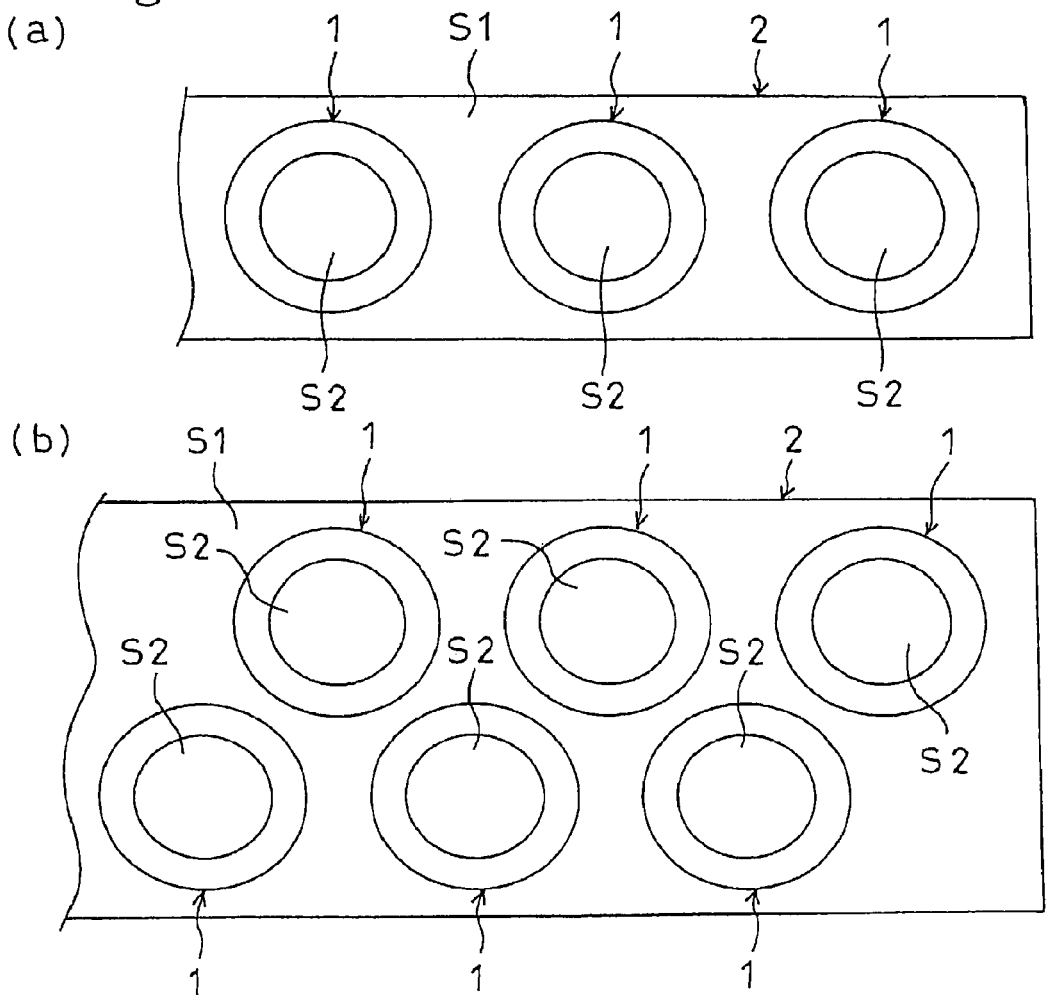
Fig.13 (PRIOR ART)
FIG. 13 is a plan view showing the conventional steps of punching out the blank from the material, where 13(*a*) shows punching out one column, 13(*b*) shows punching out in parallel.
Figure 14:
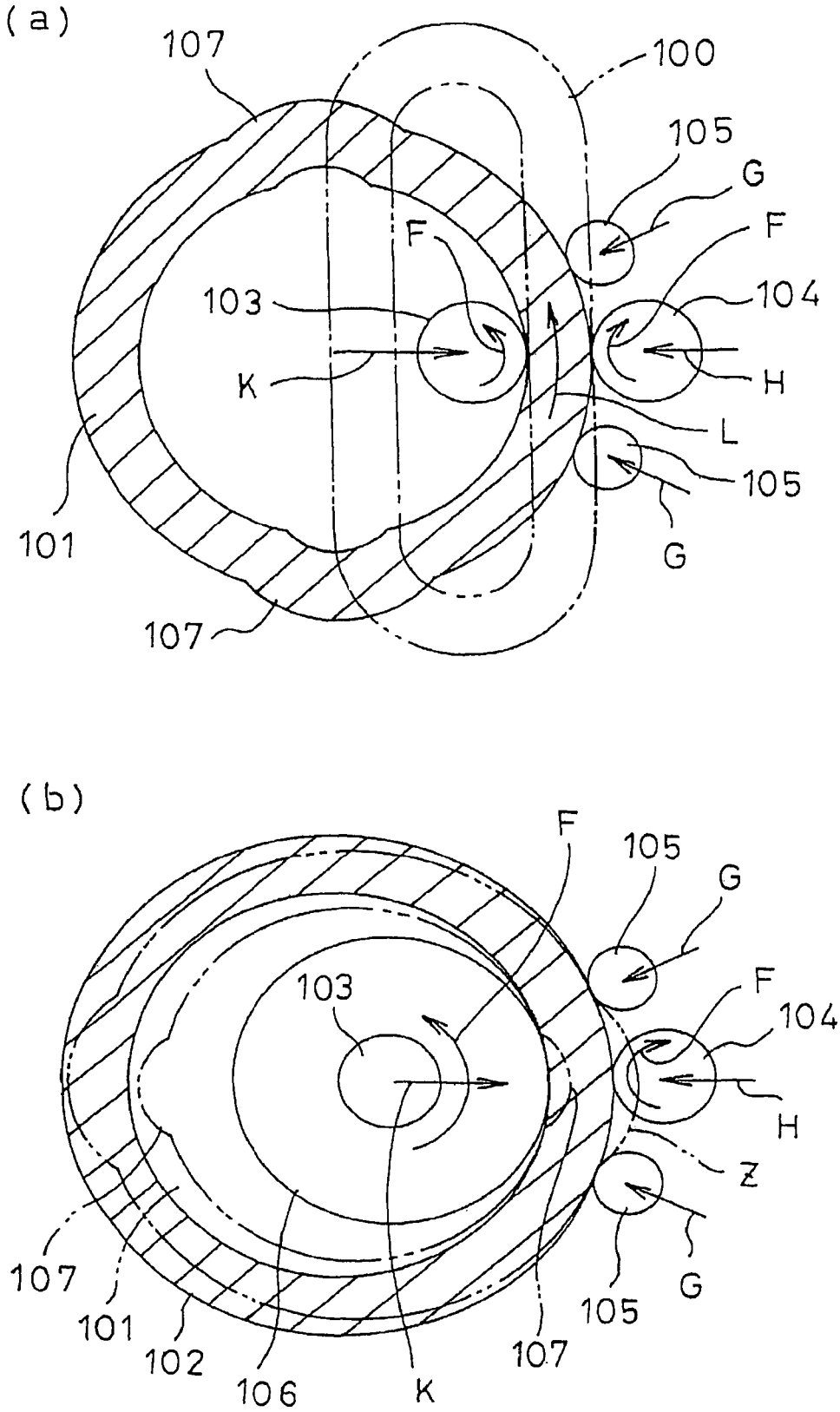
Fig.14 (PRIOR ART)
FIG. 14 is an explanatory view of a method of molding the ring-shaped member described in the patent document 1.

Therefore, according to the present invention, the ring-shaped member 1 shown in FIG. 9 and FIG. 12 is manufactured by punching out a plurality of longitudinal annular blanks 3 from a raw material 2 shown in FIG. 1, and pressing and widening the longitudinal annular blanks 3 to be molded into an annular shape by first to third shaping devices 4, 11, 19, and thus the yield rate or the percentage of the weight of the ring-shaped member 1 with respect to the weight of the raw material 2 improves, and the cost of the ring-shaped member 1 can be reduced by removing the material such that the percentage of the skeleton S1 and the slug S2 of FIG. 1 with respect to the ring-shaped member 1 is suppressed lower than the percentage of the skeleton S1 and the slug S2 with respect to the ring-shaped member 1 described in FIG. 13.

Furthermore, each curved part 3*d* is deformed along the pressing surface 12*b* when the radial outer surface of large curvature radius is pressed inward from the outer side by the pressing surface 12*b* depressed into a circular arc shape of the molding outer die 12 with the radial inner surface slightly pressed and widened by the circular arc shaped holding surface 16*a* of the holding inner die 16 and positioned with the movement in the directions of the arrows X1, X2 regulated by pressing and energizing the outer side of the pair of curved parts 3*d* of the deformed longitudinal annular blank 3A towards the curved part 3*d* on the opponent side by the pressing surface 12*b* depressed to a circular arc shape of the molding outer die 12 by the second shaping device 11, and thus "extension" in the radial outer region having large curvature radius is suppressed as much as possible, thinning of the radial inner region is avoided, and furthermore, flow of material that thickens the curved part 3*d* is generated so as to alleviate stress concentration at the radial inner region. As a result, both curved parts 3*d* can be molded to a large curved part 3D having a large curvature radius and being advantageous in manufacturing the ring-shaped member 1 without generating cracks at the curved part 3*d*, and thus the yield rate or the percentage of the ring-shaped member 1 with respect to the longitudinal annular blank 3A can be improved and the cost of the ring-shaped member 1 can be reduced.

Figure 10:
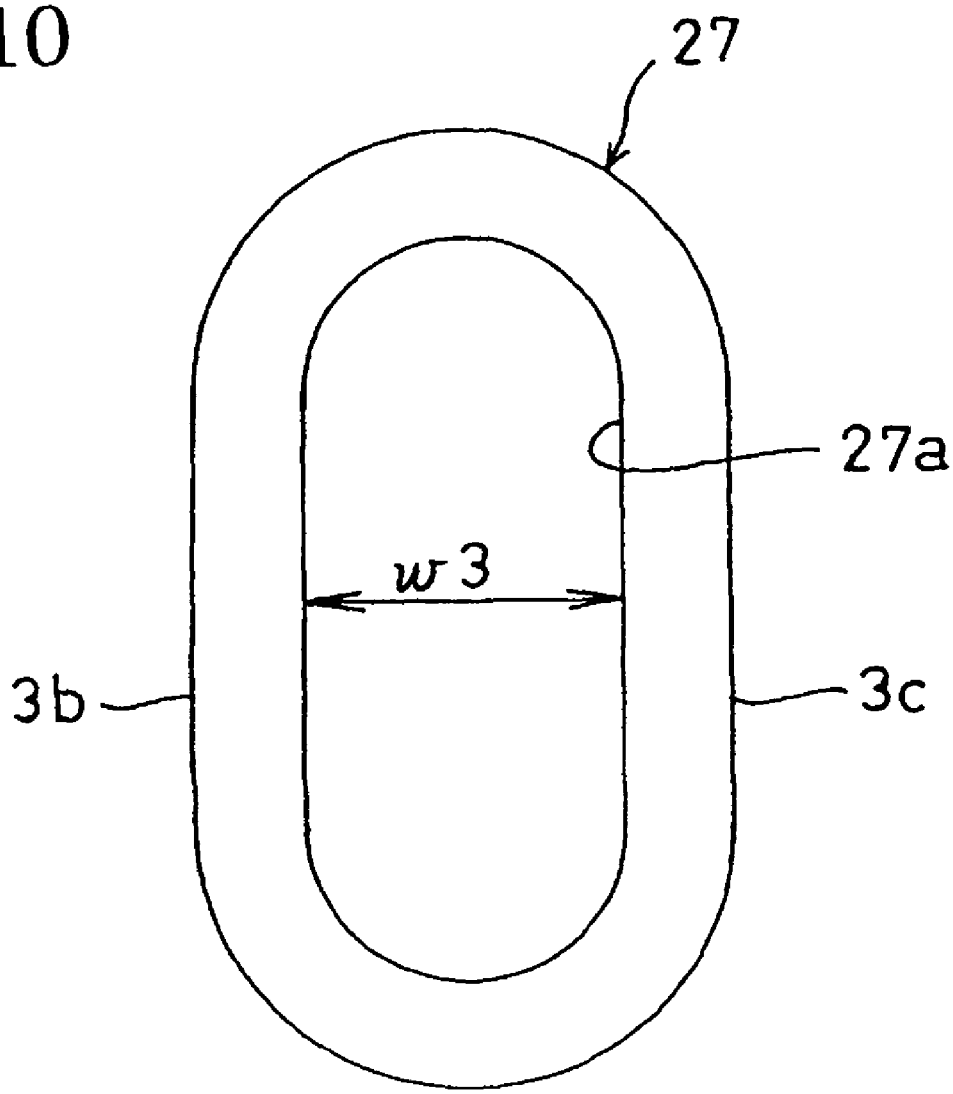
FIG. 10 is an enlarged front view showing a second embodiment of a blank.

In the above embodiment, the longitudinal annular blank 3 having a small width dimension w1 of the longitudinal hole 3*a* is punched out, and such blank 3 is pressed and widened to manufacture the ring-shaped member 1, as shown in FIG. 2, but, as shown in FIG. 10, a longitudinal annular blank 27 of frame oval shape having a longitudinal hole 27*a* of oval shape in which the width dimension w3 is sufficiently larger than the width dimension w1 of FIG. 2 may be punched out, and such blank 27 may be pressed and widened through the same procedures as the above embodiment to be molded into the ring-shaped member 1. In this case as well, the yield rate or the percentage of the ring-shaped member 1 with respect to the longitudinal annular blank 27 of frame oval shape can be improved and the cost of the ring-shaped member 1 can be reduced, similar to the above embodiment.

Figure 11:
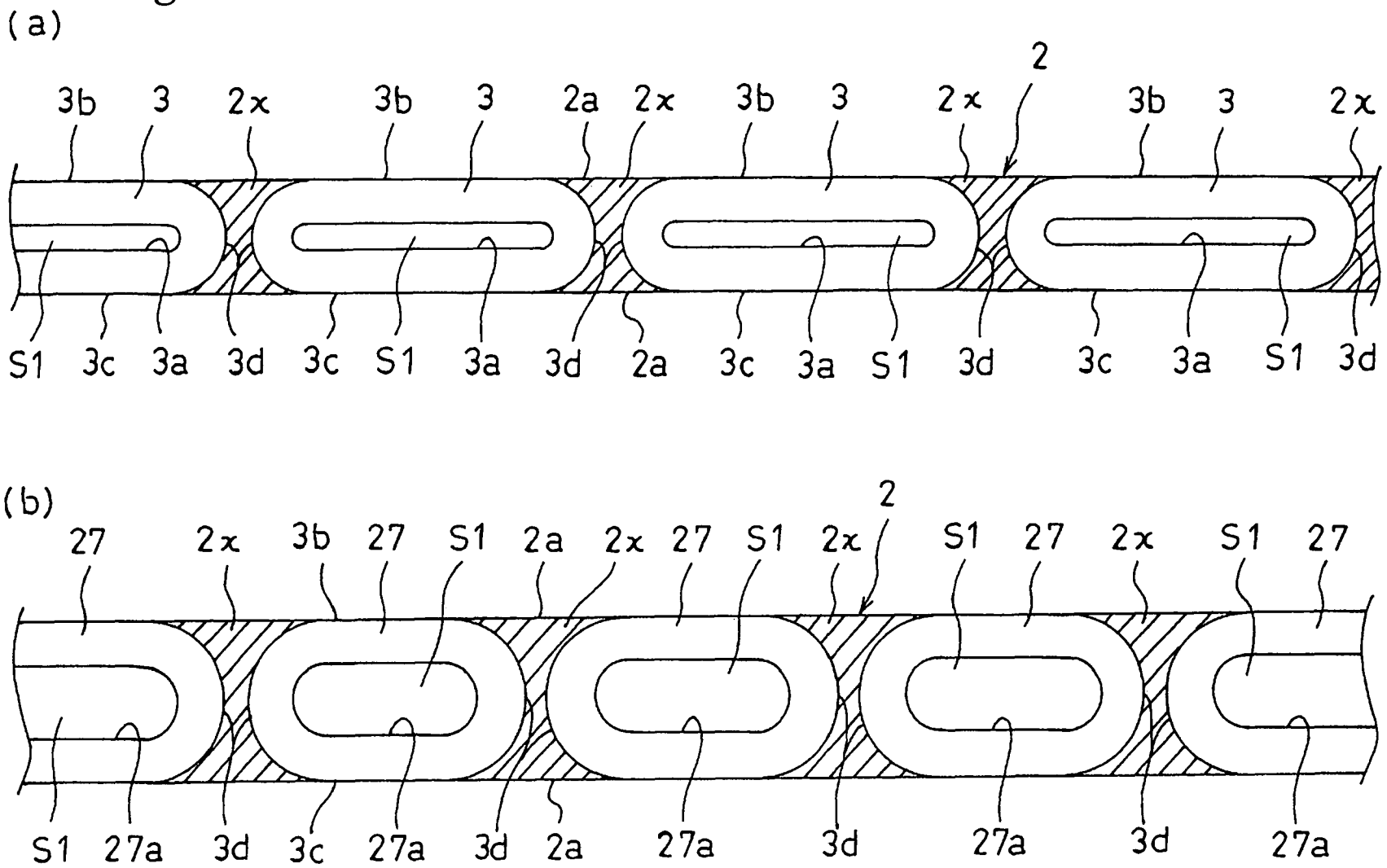
FIG. 11 is a plan view showing another embodiment of a step of punching out the blank from the raw material.

Moreover, as shown in FIGS. 11(*a*) and 11(*b*), the outer end faces of the linear parts 3*b*, 3*c* in the longitudinal annular blank 3, 27 may be formed using both ends faces 2*a* in the width direction of the raw material 2, and the raw material 2 may be cut by the pressing device to form a pair of curved parts 3*d* continuing the pair of linear parts 3*b*, 3*c* to each other at both ends in the longitudinal direction. Therefore, the material can be removed such that the percentage of scraps with respect to the longitudinal annular blanks 3, 27 is suppressed to a minimum. In other words, the scraps are reduced to the slug S1 punched out and removed by punch in time of punching out the longitudinal hole 3*a* or the longitudinal hole 27*a* of oval shape, and an end plate part 2*x* of drum shape existing between the longitudinal annular blanks 3, 27 arrayed in the longitudinal direction and to be separated away from the raw material 2, as shown with slashes in FIGS. 11(*a*) and 11(*b*). As a result, the yield rate or the percentage of the weight of the ring-shaped member 1 with respect to the weight of the raw material 2 can be further improved.

The invention claimed is:

1. A method of manufacturing a ring-shaped member, comprising the steps of:

molding an annular blank having a longitudinal extent with linear parts each forming an outer side, with a longitudinally extending hole forming inner sides, that face each other on both sides in a width direction of the annular blank, and curved parts at each longitudinal end for continuing both ends in the longitudinal direction of the linear parts, into an annular shape without rotation of the annular blank by:

pressing said curved parts at both ends in the longitudinal direction toward each other;

widening by pressing and energizing in a dimension in the width direction of the linear parts of the annular blank from the longitudinal hole;

pressing and energizing the outer side of the curved parts towards the inner side of the curved parts into said longitudinal hole which dimension in the width direction is widened; and pressing the curved parts which are widened to a large curved part having a large curvature radius.

2. The method of manufacturing the ring-shaped member according to claim 1, wherein:

the annular blank is molded into an annular shape by a shaping device including an inner die and an outer die.

3. The method of manufacturing the ring-shaped member according to claim 2, wherein:

the annular blank has end faces in the width direction;

the end faces in the width direction of the annular blank are formed by the end faces in the width direction of the raw material from which the annular blank is made, and the curved parts for continuing the linear parts to each other are formed at the ends in the longitudinal direction by cutting the raw material.

* * * * *